US005168256A

United States Patent [19]

Ishiguro et al.

[11] Patent Number: 5,168,256

[45] Date of Patent: Dec. 1, 1992

[54] RESISTOR ELEMENT USING CONDUCTORS HAVING RELATIVELY LOW THERMAL CONDUCTIVITY

[75] Inventors: Fujio Ishiguro, Nagoya; Zenji Ishikawa, Anjo, both of Japan

[73] Assignee: NGK Insulators, Ltd., Japan

[21] Appl. No.: 669,007

[22] Filed: Mar. 13, 1991

[30] Foreign Application Priority Data

Mar. 16, 1990 [JP] Japan ..... 2-67904

[51] Int. Cl.[5] ..... H01C 3/04

[52] U.S. Cl. ..... 338/25; 338/267; 338/270; 338/273; 338/324; 338/329

[58] Field of Search ..... 338/25, 267, 269, 270, 338/273, 327, 329, 330, 324

[56] References Cited

U.S. PATENT DOCUMENTS 3,626,348 12/1971 Alten ..... 338/20

3,975,307 8/1976 Matsuo et al. ..... 338/25 X 4,758,814 7/1988 Howng et al. ..... 338/329 X

*Primary Examiner*—Marvin M. Lateef

*Attorney, Agent, or Firm*—Parkhurst, Wendel & Rossi

[57] ABSTRACT

A resistor element for determining a parameter, including a ceramic support having a bearing surface, an electrically resistive body formed on the bearing surface of the ceramic support, a conductor or conductors electrically connected to the electrically resistive body, the conductor(s) having a lower thermal conductivity than a conductor made of platinum, and an adhesive for securing the conductor(s) to the ceramic support. The conductor is defined by a lead wire made of an alloy and a covering layer made of a metal which covers the lead wire. The adhesive contains at least one metal of which at least an outer surface of each conductor is formed, so as to increase bonding strength between the conductor(s) and the adhesive.

20 Claims, 3 Drawing Sheets

RESISTOR ELEMENT USING CONDUCTORS HAVING RELATIVELY LOW THERMAL CONDUCTIVITY

BACKGROUND OF THE INVENTION

1. Field of the Invention

The present invention relates in general to a resistor element, and more particularly to a resistor element utilizing temperature dependence of an electrical resistance of an electrically resistive body, such as a temperature sensing element for measuring the temperature of a gaseous fluid, for example.

2. Discussion of the Prior Art

A resistor element such as a temperature sensing element which utilizes temperature dependence of an electrical resistance is known. FIG. 1 shows an example of this type of resistor element, which includes a ceramic tube 2 formed of alumina and having an outside diameter of about 0.5 mm, and electrical conductors or leads 4 made of platinum and having a diameter of about 0.2 mm. The leads 4 are secured to opposite end portions of the ceramic tube 2 by glass fillers 6. The resistor element further includes an electrically resistive body in the form of an extremely thin platinum wire 8 having a diameter of about 20 ~ 40 μm, which is wound up about 100 turns on an outer circumferential surface of the ceramic tube 2. The opposite ends of the platinum wire 8 are coiled around the leads 4, and the leads and wire 4, 8 are welded together for electrical connection therebetween. The thus constructed resistor element is entirely covered by a protective coating made of a glass material.

There is also known a thin-film type of a resistor element as shown in FIG. 2. This resistor element has a platinum film 10 which is suitably patterned so as to have a desired resistance value, and which is formed on the outer surface of the ceramic tube 2, in place of the platinum wire 8 described above. This platinum film 10 is electrically connected to the leads 4, 4, by platinum connectors 12 which are provided on the opposite end faces of the ceramic tube 2 and the corresponding end faces of the glass fillers 6. The platinum connectors 12 are formed by baking a platinum paste (electrically conductive paste including platinum as a major component).

In practical use of the resistor element constructed as described above, the leads 4 are secured by welding to metallic rods, for example, so that the resistor element is placed in an intended position in a device. Referring to FIG. 3, for example, the resistor element 18 is disposed within a gas passage 16 which is defined by a pipe 14 such as an iron pipe, so as to measure the temperature of a gaseous fluid which flows through the passage 16. In this case, the leads 4 of the resistor element 18 are secured by welding at their opposite end portions to corresponding metallic rods 22, 22, such as stainless steel rods having a diameter of 2 mm, which are inserted into the pipe 14 through respective electrically insulating ceramic masses 20, 20 that fill holes formed through a wall of the pipe 14. Thus, the resistor element 18 is held in position within the pipe 14, with the metallic rods 22 being connected to an external device 24 such as a temperature indicator.

However, it is rather difficult for the known resistor element as described above to measure the temperature or other parameters of a measurement fluid with sufficiently high accuracy, when the environment for the measurement is rapidly changed. More specifically described by reference to FIG. 3, even if the temperature of a fluid to be measured, such as air, is rapidly changed, the temperature of the metallic rods 22 exposed to the measurement fluid remains unchanged, since the rods 22 have a relatively large heat capacity and is therefore unlikely to be highly responsive to the rapid change of the temperature of the fluid. As a result, the rate of temperature change of the resistor element 18 with the varying fluid temperature is low, due to heat transfer from the electrically resistive body 8, 10 to the metallic rods 22, or vice versa, through the leads 4. Namely, the temperature change of the resistor element 18 cannot follow the rapid change of the temperature of the fluid to be measured. Thus, the known resistor element suffers from reduced detecting accuracy upon a rapid change of the temperature of the measurement fluid.

To improve the operating response of the resistor element when the temperature of the measurement fluid is rapidly changed, the inventors of the present invention tried using a material having a lower thermal conductivity than platinum, for the leads of the resistor element which had conventionally been formed of platinum. In the resistor element of FIG. 2, for example, the leads 4 in the form of platinum wires were replaced by stainless steel wires having the same diameter as the platinum wires, to prepare an intended resistor element having an improved operating response. The stainless steel wires of the thus prepared resistor element were secured by spot welding (a type of resistance welding) to the metallic rods 22 as shown in FIG. 3, and the temperature of the fluid in the pipe 14 was actually measured. The inventors found some abnormal values in the measurements obtained by this resistor element.

Further study and analysis by the present inventors revealed that the abnormal values in the result of the measurement were caused by poor electrical conduction between the leads (stainless steel wires) and the electrically resistive body. When the leads (stainless steel wires) 4 of the resistor element of FIG. 2 and the metallic rods 22 are secured to each other by resistance welding, a considerable amount of flexural, bending or tensile force is applied to the leads 4 from the resistance welding electrodes. Since the leads 4 cannot endure such flexural or tensile force, the leads 4 tend to be more or less pulled out of the glass fillers 6, causing unfavorable clearances and cracks between the leads 4 and the glass fillers 6, which result in poor contact between the leads 4 and the platinum connectors 12 (i.e., poor electrical conduction between the leads 4 and the platinum film 10).

The above-described problem is often encountered in the case where the leads are formed of stainless steel or other material having a relatively low thermal conductivity. When the conventional platinum wires are used as the leads, on the other hand, the leads tend to be cut off rather than being pulled out of the glass fillers, when the excessive force is applied to the leads.

SUMMARY OF THE INVENTION

The present invention was developed in view of the above circumstances of the prior art. It is therefore an object of the invention to provide a resistor element which overcomes the problem encountered in the prior art, and which has an improved operating response, and significantly increased bonding strength of electrical conductors.

The above object may be achieved according to the principle of the present invention, which provides a resistor element for determining a parameter, comprising: a ceramic support having a bearing surface, an electrically resistive body formed on the bearing surface of the ceramic support, conductor means electrically connected to the electrically resistive body, the conductor means having a lower thermal conductivity than a conductor made of platinum, and bonding means for securing the conductor means to the ceramic support. The bonding means contains at least one metal of which at least an outer surface of the conductor means is formed.

In the resistor element of the present invention constructed as described above, the conductor means is formed of a metallic material which has a lower thermal conductivity than platinum. Namely, the conductor means in the form of a lead wire has a lower thermal conductivity than a conventional lead wire formed of platinum, when these lead wires have the same dimensions (i.e., diameter, cross sectional area, and length). Therefore, an amount of heat transfer through the conductor means can be effectively limited even if the ambient temperature is rapidly changed. According to the present invention, at least one metal of which at least an outer surface of the conductor means is formed is contained in the bonding means for securing the conductor means to the ceramic support. This arrangement causes effective bonding between the metal or metals constituting the conductor means and the same metal or metals contained in the bonding means, leading to significantly increased bonding strength between the conductor means and the bonding means, namely, between the conductor means and the ceramic support.

Accordingly, even if the ambient temperature, i.e., the temperature of a fluid to be measured by the resistor element, is rapidly changed, the present resistor element as described above faithfully keeps up with the rapid change of the ambient temperature, and is therefore able to measure the temperature with sufficiently high accuracy and improved operating response. As stated above, the bonding strength between the conductor means and the bonding means is significantly improved. Therefore, even when the external force such as bending or tensile force acts on the conductor means, the conductor means is prevented from being separated from the bonding means, and unfavorable clearances or cracks are unlikely to occur at an electrically connecting portion between the conductor means and the electrically resistive body, whereby otherwise possible reduction in the electrical conduction between the conductor means and the electrically resistive body can be effectively avoided. Consequently, the present resistor element is almost free from abnormal measurement of the temperature.

The conductor means may be principally made of an alloy which has a thermal conductivity of not higher than one-third of that of platinum. For example, the alloy is selected from the group which consists of nichrome, bronze, MONEL (Ni-Cu alloy), INVAR (Fe-Ni-C-Cr alloy), stainless steel and Ni-Fe alloy. The conductor means may include at least one lead wire, each consisting of a wire rod formed of the alloy, and a covering layer formed of the above-indicated at least one metal contained in the bonding means, such that the covering layer is formed on an outer surface of the wire rod.

The bonding means may contain a glass as a bonding material. For example, the glass is a crystallized glass which includes $ZnO.B_2O_3.SiO_3$. The bonding means may contain from 7% to 70% the above-indicated at least one metal of which at least an outer surface of the conductor means is formed.

The conductor means and the bonding means may be bonded together by heat treatment at a temperature higher than one-third of a melting point of the above-indicated at least one metal contained both in the conductor and bonding means, while the conductor means is secured in place with respect to the ceramic support by the bonding means. This heat treatment may be effected under an inert atmosphere.

BRIEF DESCRIPTION OF THE DRAWINGS

The foregoing and other objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
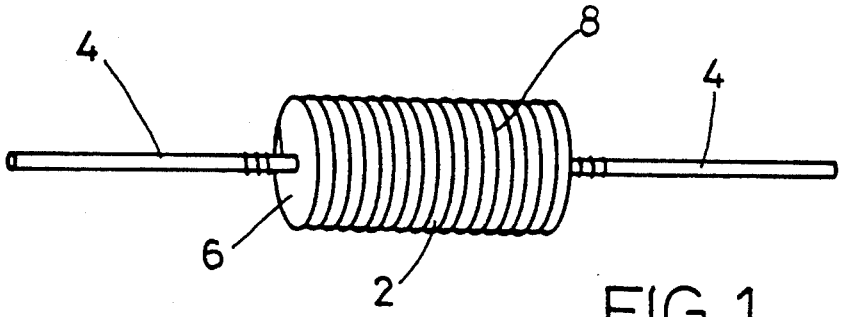
FIG. 1 PRIOR ART
FIG. 1 is a perspective view showing an example of known resistor element.

The resistor element of the present invention has the same construction as that of the known resistor element as described above, except for the kinds of a material used for electrical conductors or leads, and an adhesive for securing the conductors in position. While some embodiments of the present invention are shown in FIGS. 4 through 6, for illustrative purpose only, the resistor element of the invention may be constructed as shown in FIGS. 1 and 2.

Figure 2:
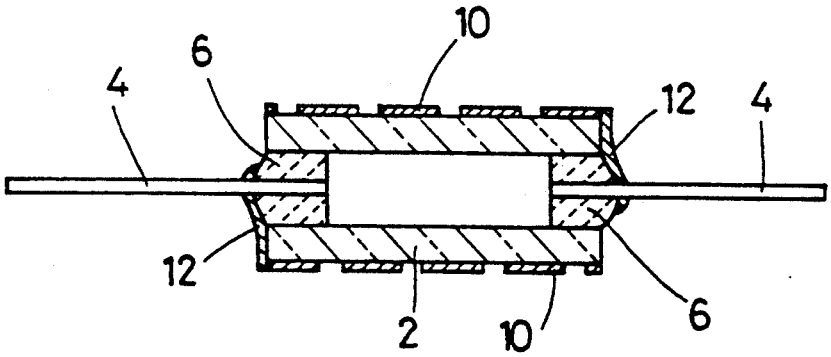
FIG. 2 PRIOR ART
FIG. 2 is a schematic elevational view in longitudinal cross section of another example of known resistor element.
Figure 4:
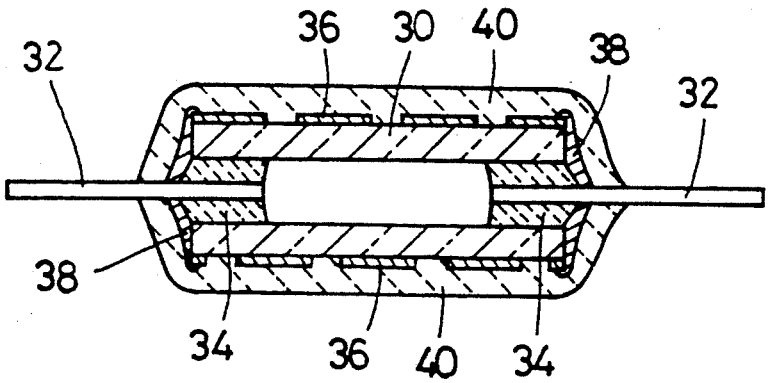
FIGS. 4, 5 and 6 are schematic elevational views in longitudinal cross section of different embodiments of a resistor element of this invention, respectively.

Referring first to the cross sectional view of FIG. 4, there is shown the first embodiment of the resistor element of the present invention, which is similar in construction to the known resistor element of FIG. 2. This resistor element has a tubular ceramic support 30 formed of a known ceramic material such as alumina, and a pair of electrical conductors or lead wires 32, 32 secured to the tubular support 30. More specifically, the lead wires 32, 32 are inserted suitable distances at their end portions in respective end portions of a central bore of the tubular support 30, and secured to the inner surface of the support 30 by corresponding adhesive masses 34 which will be described later. On the outer circumferential surface of the tubular support 30, there is provided an electrically resistive body in the form of a resistor film 36 formed of platinum, for example, such that the resistor film 36 is formed in a suitable pattern as in the known resistor body (FIG. 2). This resistor film 36 is electrically connected to the lead wires 32, through respective connectors 38, 38 which are provided on the opposite end faces of the tubular support 30 and the corresponding end faces of the adhesive masses 34. The instant resistor element further has a protective coating layer 40 made of a glass material, for example, for covering the outer surfaces of the tubular support 30, connectors 38 and corresponding portions of the lead wires 32, 32, as shown in FIG. 4.

Figure 5:
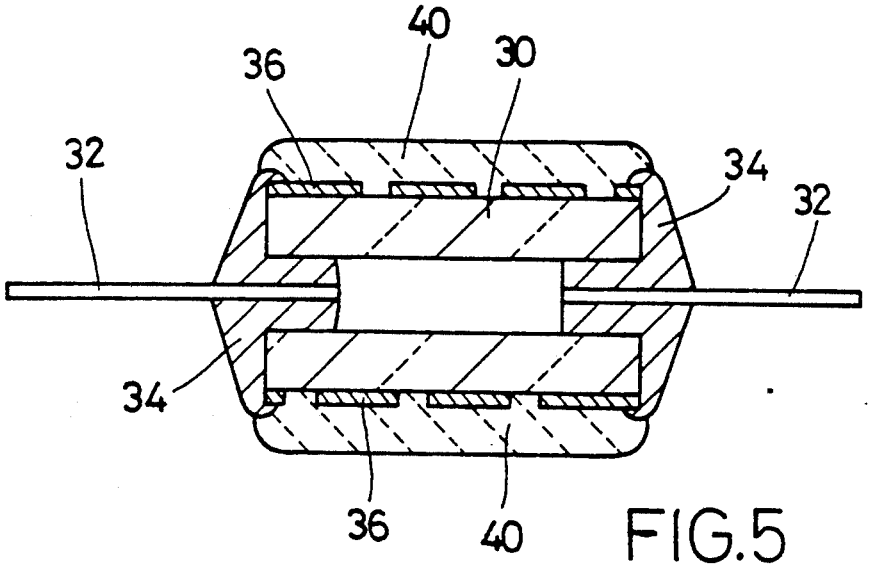

FIG. 5 shows a modification of the resistor element of FIG. 4, wherein the resistor film 36 formed on the outer circumferential surface of the tubular support 30 is electrically connected to the lead wires 32, by the adhesive masses 34, 34 which are secured to the opposite end faces of the tubular support 30, as well as to the inner surfaces of the opposite open end portions of the support 30. As in the preceding embodiment, an adhesive mixture for providing the adhesive masses 34 contains a metallic material of which at least outer surfaces of the lead wires 32 are formed. Accordingly, the electrical connection between the resistor film 36 and the lead wires 32 may be achieved by increasing an amount of the metallic material contained in the adhesive mixture (34).

Figure 6:
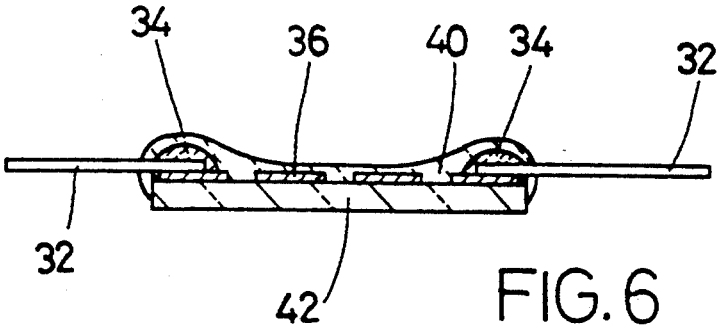

Referring to the cross sectional view of FIG. 6, there is illustrated another embodiment of the resistor element of the present invention, in which the ceramic support takes the form of a ceramic substrate 42 having a flat bearing surface on which the resistor film 36 is formed in a suitable pattern. The lead wires 32, 32 are secured to the resistor film 36 by respective adhesive masses 34, for electrical connection therebetween. As in the embodiments of FIGS. 4 and 5, the protective coating 40 made of a glass, for example, is provided on the bearing surface of the ceramic substrate 42 on which the resistor film 36 is formed.

The lead wires 32 used in the resistor element of the present invention are formed of a metallic material having a thermal conductivity lower than that of platinum. While the metallic material may be selected from pure metals, the lead wires 32 are preferably formed of an alloy in view of its melting point and thermal conductivity. Typical examples of alloy used for the lead wires 32 include nichrome, bronze, MONEL (Ni-Cu alloy), INVAR (Fe-Ni-C-Cr alloy) stainless steel and Ni-Fe alloy, all of which exhibit a thermal conductivity not higher than one-third of that of platinum. The MONEL may consist principally of 66 weight % of Ni, 29 weight % of Cu and 3 weight % of Al, while the INVAR may consist principally of 35.4 weight % of Ni, 0.06 weight % of C, 0.04 weight % of Cr, and the balance being Fe. It is to be understood that the lead wires 32 are not necessarily wholly formed of a single metallic material having a lower thermal conductivity than platinum. Namely, each of the lead wires 32 may consist of a wire rod made of the metallic material as described above, and a covering layer made of a suitable metal other than the above-described metals, for covering the outer surface of the wire rod, provided that the lead wire 32 as a whole has a lower thermal conductivity than that of a platinum wire having the same size as the lead wire 32.

For improved bonding strength between the lead wires 32 and the adhesive masses 34, the adhesive mixture giving the adhesive masses 34 contains at least one metal which forms or constitutes at least the outer surfaces of the lead wires 32. While a bonding material contained in the adhesive mixture may be selected from any known materials for bonding a ceramic and a metal together, it is generally preferable to employ a glass as the bonding material. Of various kinds of glass, it is particularly desirable to use a crystallized glass, such as those including $ZnO.B_2O_3.SiO_2$. In this case, the bonding strength between the adhesive masses 34 and the lead wires 32 can be increased by 10% or more. This improvement of the bonding strength is attributed to the crystallization of glass contained in the adhesive, which prevents occurrence of cracking of the adhesive masses 34 leading to deterioration of the bonding strength, which cracking would otherwise result from the flexural, bending, or tensile force acting on the lead wire 32.

As stated above, the adhesive mixture (34) contains the metal or metals used for the outer surface of the lead wire 32. The metal content of the adhesive mixture (34) may be suitably determined as desired, generally within a range of about 7% ~ 70% by volume. It will be readily understood that when the electrically conduction between the lead wires 32 and the resistor film 36 is established only by the adhesive masses 34, as in the embodiment of FIG. 5, the metal content of the adhesive mixture (34) is determined to be relatively high within the above range.

For securing the lead wires 32 to the ceramic support, such as the tubular support 30 or ceramic substrate 42, with the adhesive masses 34 as described above, the resistor element is subjected to heat treatment, that is, the element is fired, while the lead wires 32 are fixed in place by the adhesive masses 34 with respect to the ceramic support 30, 42. As a result of the heat treatment, the adhesive masses 34 are fused and firmly adhered to the lead wires 32 and the ceramic support 30, 42. In this respect, it is desirable that the resistor element is heat-treated or fired at a temperature higher than one-third of the melting point of the metal contained in the adhesive mixture (34), so as to establish a strong bond between the lead wires 32 and the metal component of the adhesive masses 34. This leads to significantly increased bonding strength between the lead wires 32 and the adhesive masses 34. It is also desirable that the heat treatment is effected under an inert atmosphere, such as nitrogen, so that the lead wires 32 are prevented from oxidizing at their portions in contact with the adhesive masses 34, assuring increased bonding strength between the wires 32 and the adhesive masses 34.

To further clarify the concept of the present invention, there will be described in detail some specific examples of the resistor element of the invention. However, it is to be understood that the invention is not limited to the precise details of these examples, but the invention may be embodied with various changes, modifications and improvements which may occur to those skilled in the art, without departing from the spirit and scope of the invention.

EXAMPLE 1

A resistor element having a structure as shown in FIG. 4 was prepared by using an alumina tube as the ceramic support, which has an inside diameter of 0.3 mm, an outside diameter of 0.5 mm, and a length of 2 mm. Platinum was applied over the outer circumferential surface of the almina tube by a sputtering technique, to form a platinum film having a thickness of 0.8 μm. Then, the platinum film was trimmed by a laser so as to obtain a patterned platinum layer which is defined by a spiral groove formed in the platinum film. The thus obtained patterned platinum layer had a resistance value of 100Ω.

On the other hand, a glass paste was prepared as an adhesive by mixing 10% by volume of a nickel powder with 90% by volume of a glass having a working temperature of 750° C., and adding an organic binder and terpineol to the mixture. After a pair of lead wires in the form of stainless steel wires (SUS 304) having a diameter of 0.2 mm were inserted into the opposite end portions of a central bore of the alumina tube, the glass paste was applied to the opposite end portions of the alumina tube, so as to fix the lead wires in position. Then, the masses of the glass paste filling the annular spaces between the stainless steel wires and the alumina tube were dried. The thus prepared assembly of the alumina tube with the lead wires tentatively secured thereto was then fired at a temperature of 750° C. for 10 minutes, under a nitrogen atmosphere, so that the lead wires were secured to the opposite end portions of the inner surface of the almina tube, by the fired glass masses or glass fillers.

Subsequently, a platinum paste was applied to the opposite end faces of the alumina tube and the corresponding end faces of the glass fillers, and then fired at a temperature of 700° C. for 5 minutes, to form platinum connectors so as to establish the electrical conduction between the lead wires secured to the alumina tube, and the platinum layer formed on the outer surface of the alumina tube. Thereafter, the alumina tube, platinum layer, platinum connectors and portions of the lead wires were covered with glass, to form a protective coating thereon. In this manner, an intended resistor element was completed.

A tensile test conducted on the five lead wire specimens of the thus obtained resistor element showed no separation of any of the five specimens from the glass fillers. The lead wires were cut off when the tensile force or load applied to the wires amounted to 1400–1700 g.

Figure 3:
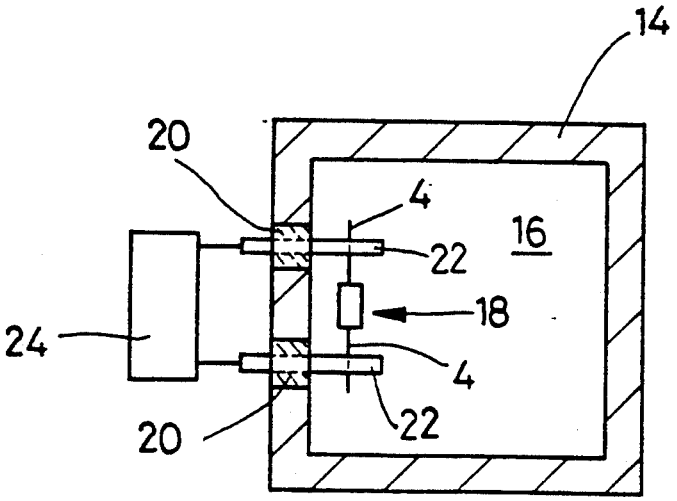
FIG. 3 is a schematic explanatory view showing an arrangement in which the resistor element of FIG. 1 or 2 is disposed in a temperature sensing device for actual measurement of the temperature of a gaseous fluid.

The resistor element constructed as described above was installed on a temperature sensing device as shown in FIG. 3, and used as a temperature sensing element for measuring the temperature of a gaseous fluid in the passage (14). The resistor element thus installed was evaluated in terms of its operating response and its measuring accuracy when the temperature of the fluid was rapidly changed. It was revealed that the present resistor element had a much better operating response than the conventional resistor element with platinum lead wires. In addition, abnormal measurement by the instant resistor element was not found.

Another resistor element similar to that of the above-described example was prepared by plating with nickel the stainless steel wires (SUS 304) used as the lead wires in the above example. In this case, too, the lead wires were secured to the alumina tube with sufficiently high bonding strength with respect to the glass fillers, which contain nickel.

EXAMPLE 2

A resistor element having a structure as shown in FIG. 5 was prepared by using an alumina tube as the ceramic support, which has an inside diameter of 0.20 mm, an outside diameter of 0.45 mm, and a length of 2.5 mm. As in EXAMPLE 1, platinum was applied over the outer circumferential surface of the alumina tube, to form a platinum film which was suitably patterned to provide a patterned platinum layer having a resistance value of 100Ω.

To the opposite end portions of this alumina tube, there were secured a pair of lead wires having a diameter of 0.13 mm, by using a glass paste composed of 60% by volume of platinum and 40% by volume of glass. The lead wires were 40% Ni-Fe wires, each containing 40% by weight of Ni and having an outer surface covered by a 3 μm platinum plating. The thus prepared assembly of the alumina tube with the lead wires tentatively secured thereto was fired at a temperature of 700° C. for 5 minutes in the air. Subsequently, the assembly was coated with glass, and then fired at a temperature of 680° C. for 5 minutes in the air, so that a protective glass coating was formed on the outer circumferential surface of the alumina tube. In this manner, the intended resistor element as shown in FIG. 5 was obtained.

When the tensile strength of the five lead wires of the thus, obtained resistor element was tested, the lead wires broke when the tensile force or load applied to the wires amounted to 1250–1380 g. None of the five specimens were pulled out of or separated from the resistor element before they were broken.

EXAMPLE 3

Various specimens of the resistor element as shown in FIG. 5 were prepared, which had respective lead wires and/or adhesive mixtures which were different from those of the resistor element of EXAMPLE 2. All of these specimens exhibited sufficiently high bonding strength between the lead wires and the adhesives.

SPECIMEN A)

The lead wires of this specimen were 40% Ni-Fe wires whose outer surface were coated with platinum by evaporation.

SPECIMEN B)

The lead wires were 40% Ni-Fe wires whose outer surfaces were plated with nickel. The adhesive mixture used in this specimen was prepared from a glass paste composed of 30% by volume of nickel, 30% by volume of platinum, and 40% by volume of glass. The adhesive masses applied between the alumina tube and the respective lead wires were fired under a $N_2$ atmosphere.

SPECIMEN C)

The lead wires were obtained from 40% Ni-Fe wires, each having an outer surface covered by a 1 μm-thick silver layer formed by evaporation. The adhesive mixture was prepared from a glass paste composed of 20% by volume of silver, 20% by volume of platinum, and 60% by volume of glass.

SPECIMEN D)

The lead wires were 40% Ni-Fe wires, each having an outer surface covered by a 7 μm-thick palladium layer formed by plating. The adhesive mixture used in this specimen was prepared from a glass paste including 40% by volume of palladium.

SPECIMEN E)

The lead wires were 40% Ni-Fe wires, each having an outer surface covered by a 0.5 μm-thick rhodium layer formed by sputtering. The adhesive mixture was prepared from a glass paste including 20% of Rh-Pt alloy.

SPECIMEN F)

The lead wires were obtained from clad materials, that is, 52% Ni-Fe core wires whose outer surface is covered by a 2μm-thick platinum film.

EXAMPLE 4

A resistor element having a structure as shown in FIG. 6 was prepared by using a $BeO_2$ ceramic substrate as the ceramic support, which has a thickness of 1 mm and a width of 2 mm. As in EXAMPLE 1, platinum was applied over one of the opposite major surfaces of the ceramic substrate, to form a platinum film which was suitably patterned in a zigzag fashion to provide a patterned platinum layer having a resistance value of 100Ω.

To the opposite end portions of this ceramic substrate, there are secured a pair of lead wires having a diameter of 0.20 mm, by using a glass paste composed of 10% by volume of platinum, 10% by volume of iron, 5% by volume of nickel, and the balance consisting of glass. The lead wires were 40% Ni-Fe wires, each having an outer surface covered by a 3μm-thick platinum layer formed by plating. Then, the thus prepared assembly of the ceramic subtrated with the lead wires tentatively secured thereto was fired at a temperature of 780° C. for 10 minutes under a $N_2$ atmosphere. Subsequently, the fired assembly was coated with glass, and then baked at a temperature of 700° C. for 5 minutes, so that a protective glass coating was formed on the above-indicated one major surface of the ceramic substrate. In this manner, the intended resistor element as shown in FIG. 6 was obtained.

The tensile strength of the five lead wire specimens of the thus obtained resistor element was tested. None of the specimens were removed from the glass masses. The specimens were broken when the tensile force or load applied to the wires amounted to 1000-1500 g.

EXAMPLE 5

The resistor element of this example is identical with the resistor element of EXAMPLE 1, except that the glass material of the glass paste consists of crystallized glass including $ZnO.B_2O_3.SiO_2$, which is crystallized at a temperature of 850° C. The assembly of the alumina tube with the lead wires secured thereto with the crystallized glass was fired at a temperature of 720° C. for 15 minutes, and further fired at a temperature of 850° C. for 30 minutes, under a $N_2$ atmosphere, so that the lead wires were firmly secured to the alumina tube with the fired glass paste masses. In this example, the bonding strength between the glass masses and the lead wires was increased by 10% or more than that in EXAMPLE 1.

What is claimed is:

1. A resistor element for determining a parameter, comprising:
   - a ceramic support having a bearing surface:
   - an electrically resistive body formed on said bearing surface of said ceramic support;
   - at least one lead wire defined by a wire rod formed of an alloy, and a covering layer formed of a metal which covers said wire rod, said at least one lead wire being electrically connected to said electrically resistive body, said at least one lead wire having a lower thermal conductivity than platinum; and
   - bonding means for securing said at least one lead wire to said ceramic support, said bonding means containing said metal of which said covering layer is formed.

2. The resistor element of claim 1, wherein the thermal conductivity of said alloy is not higher than one-third of that of platinum.

3. The resistor element of claim 1 wherein said alloy is selected from the group consisting of nichrome, bronze, Ni-Cu alloy, Fe-Ni-C-Cr alloy, stainless steel and Ni-Fe alloy.

4. The resistor element of claim 1, wherein said bonding means contains a glass as a bonding material.

5. The resistor element of claim 4, wherein said glass is a crystallized glass.

6. The resistor element of claim 5, wherein said crystallized glass includes $ZnO.B_2O_3.SiO_3$.

7. The resistor element of claim 1, wherein said bonding means contains from 7% to 70% said at least one metal.

8. The resistor element of claim 1, wherein said at least one lead wire and said bonding means are bonded together by heat treatment at a temperature higher than one-third of a melting point of said metal, while said at least one lead wire is secured in place with respect to said ceramic support by said bonding means.

9. The resistor element of claim 8, wherein said heat treatment is effected under an inert atmosphere.

10. The resistor element of claim 1, wherein said ceramic support is formed of alumina.

11. The resistor element of claim 1, wherein said ceramic support consists of a cylindrical member which has a circumferential outer surface as said bearing surface on which said electrically resistive body is formed, said cylindrical member further having a bore in which said bonding means exists for securing said at least one lead wire to said cylindrical member.

12. The resistor element of claim 11, wherein said bore is formed through said cylindrical member, and said at least one lead wire consists of two lead wires whose end portions are inserted into open end portions of said bore and embedded in said bonding means.

13. The resistor element of claim 12, further comprising two connectors for electrically connecting said two lead wires to two opposite ends of said electrically resistive body, respectively.

14. The resistor element of claim 1, wherein said at least one lead wire is electrically connected to said electrically resistive body by said 15. The resistor element of claim 1, wherein said ceramic support consists of a planar substrate which has opposite major surfaces one of which provides said bearing surface on which said electrically resistive body is formed, and wherein said at least one lead wire consists of two lead wires whose end portions are secured to said one major surface of said planar substrate by said bonding means.

16. The resistor element of claim 1, wherein said electrically resistive body consists of a platinum film which is patterned so as to give a predetermined degree of resistance.

17. The resistor element of claim 1, wherein said metal is selected from the group consisting of platinum, silver, palladium and rhodium.

18. The resistor element of claim 1, which is used as a temperature sensing element for measuring a temperature of a gaseous fluid, depending upon a change in an electrical resistance of said electrically resistive body with said temperature.

19. A resistor element for determining a parameter, comprising:
   - a ceramic support having a bearing surface:
   - an electrically resistive body formed on said bearing surface of said ceramic support;
   - at least one lead wire defined by a wire rod formed of an alloy, and a covering layer formed of a metal which covers said wire rod, said lead wire being electrically connected to said electrically resistive body, said at least one lead wire having a lower thermal conductivity than platinum;

bonding means for securing said at least one lead wire to said ceramic support, said bonding means containing said metal of which said covering layer is formed; and a protective coating covering at least said bearing surface of said ceramic support, and said electrically resistive body.

20. A resistor element of claim 19, wherein said protective coating is made of a glass.

* * * * *